US006946896B2

(12) United States Patent
Behzad

(10) Patent No.: US 6,946,896 B2
(45) Date of Patent: Sep. 20, 2005

(54) HIGH TEMPERATURE COEFFICIENT MOS BIAS GENERATION CIRCUIT

(75) Inventor: Arya Reza Behzad, Poway, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 10/447,790

(22) Filed: May 29, 2003

(65) Prior Publication Data

US 2004/0239404 A1 Dec. 2, 2004

(51) Int. Cl.[7] ..... G05F 1/10
(52) U.S. Cl. ..... 327/512; 327/543
(58) Field of Search ..... 327/512, 513, 327/530, 534, 535, 537, 538, 540, 541, 542, 543, 545, 546

(56) References Cited

U.S. PATENT DOCUMENTS 4,743,862 A 5/1988 Scheinberg
4,959,622 A 9/1990 Kearney
5,157,285 A 10/1992 Allen
5,349,286 A * 9/1994 Marshall et al. ..... 323/315
5,892,388 A * 4/1999 Chiu ..... 327/543
5,990,727 A 11/1999 Kimura
6,107,868 A * 8/2000 Diniz et al. ..... 327/543
6,271,710 B1 8/2001 Ooishi
6,323,725 B1 11/2001 Goldblatt et al.
6,348,835 B1 2/2002 Sato et al.
6,407,623 B1 6/2002 Bazarjani et al.
6,448,844 B1 * 9/2002 Cho ..... 327/538
6,489,831 B1 * 12/2002 Matranga et al. ..... 327/512
6,570,436 B1 * 5/2003 Kronmueller et al. ..... 327/538
6,727,744 B2 * 4/2004 Nagaya ..... 327/540

OTHER PUBLICATIONS

EP Search Report for European Patent Application No. 04007356.1–2206.

* cited by examiner

*Primary Examiner*—Jeffrey Zweizig
(74) *Attorney, Agent, or Firm*—Christie, Parker & Hale, LLP

(57) ABSTRACT

A high temperature coefficient includes a temperature dependent bias generation circuit serially coupled with a variable resistance. The resistance of the variable resistance device increases with increasing temperature such that the output current of the high temperature coefficient circuit is proportional to the resistance of the variable resistance device.

19 Claims, 7 Drawing Sheets

HIGH TEMPERATURE COEFFICIENT MOS BIAS GENERATION CIRCUIT

BACKGROUND

This invention generally relates to analog circuits and systems and more particularly relates to high temperature coefficient communication circuits and systems.

Amplifiers are commonly employed within integrated circuits as components of a variety of analog signal processing circuits. However, variations in amplifier temperature may cause large variations in the transconductance ($G_m$) of field effect transistors (FETs) which are commonly used in analog processing circuits.

For example, the transconductance of an FET is typically inversely proportional to temperature, such that increases in device temperature decrease the transconductance of the device. Therefore, in Metal-Oxide-Semiconductor (MOS) design, it may be necessary to compensate for the temperature related effects on performance. Temperature compensation can be accomplished by altering the gate bias voltage of the transistor so that the gate bias voltage is modulated (up or down) when transconductance is altered by the effect of temperature. For example, when the transconductance is reduced under conditions of higher temperature, the gate bias voltage is increased to such a degree that the transconductance of the transistor is actually increased to reverse the effect of temperature.

In practice, if the transconductance of the device is kept relatively constant over temperature, the gain of the amplifier (determined by the product of the load impedance and the transconductance (gm)) remains relatively constant over temperature if the load has a relatively low temperature coefficient. In addition, the load of low frequency open loop circuits is typically a resistor, which, for many processes, may have a relatively low temperature coefficient. Therefore the performance of a low frequency system having a constant transconductance over temperature often remains relatively stable over temperature.

However, open loop loads at high frequency tend to be inductive to tune out the parasitic capacitance on the output node. The effective output impedance of the amplifier is therefore $Q^2R$ where Q is the quality factor of the inductor and R, the series resistance of a non-ideal inductor, which typically has a relatively high temperature coefficient. Therefore, the effective impedance of the inductive load varies with temperature as does the resulting transconductance of the device. This may result in a relatively large gain variation with varying temperature.

SUMMARY OF THE INVENTION

In one aspect of the present invention a high temperature coefficient circuit includes a temperature dependent bias generation circuit serially coupled with a variable resistance device. The resistance of the variable resistance device increases with increasing temperature such that the output current of the high temperature coefficient circuit is proportional to the resistance of the variable resistance device.

In another aspect of the present invention an RF communication system includes a transmit node for transmitting an RF information signal. The transmit node includes a high temperature coefficient circuit for biasing an amplifier, wherein the high temperature coefficient circuit includes a temperature dependent bias generation circuit serially coupled with a variable resistance device. The resistance of the variable resistance device increases with increasing temperature such that the output current of the high temperature coefficient circuit is proportional to the resistance of the variable resistance device. The RF communication system further includes a receive node for receiving the transmitted RF information signal.

BRIEF DESCRIPTION OF THE DRAWINGS

The present invention will become better understood with regard to the following description, appended claims, and accompanying drawings, in which:

DETAILED DESCRIPTION OF THE INVENTION

Figure 1:
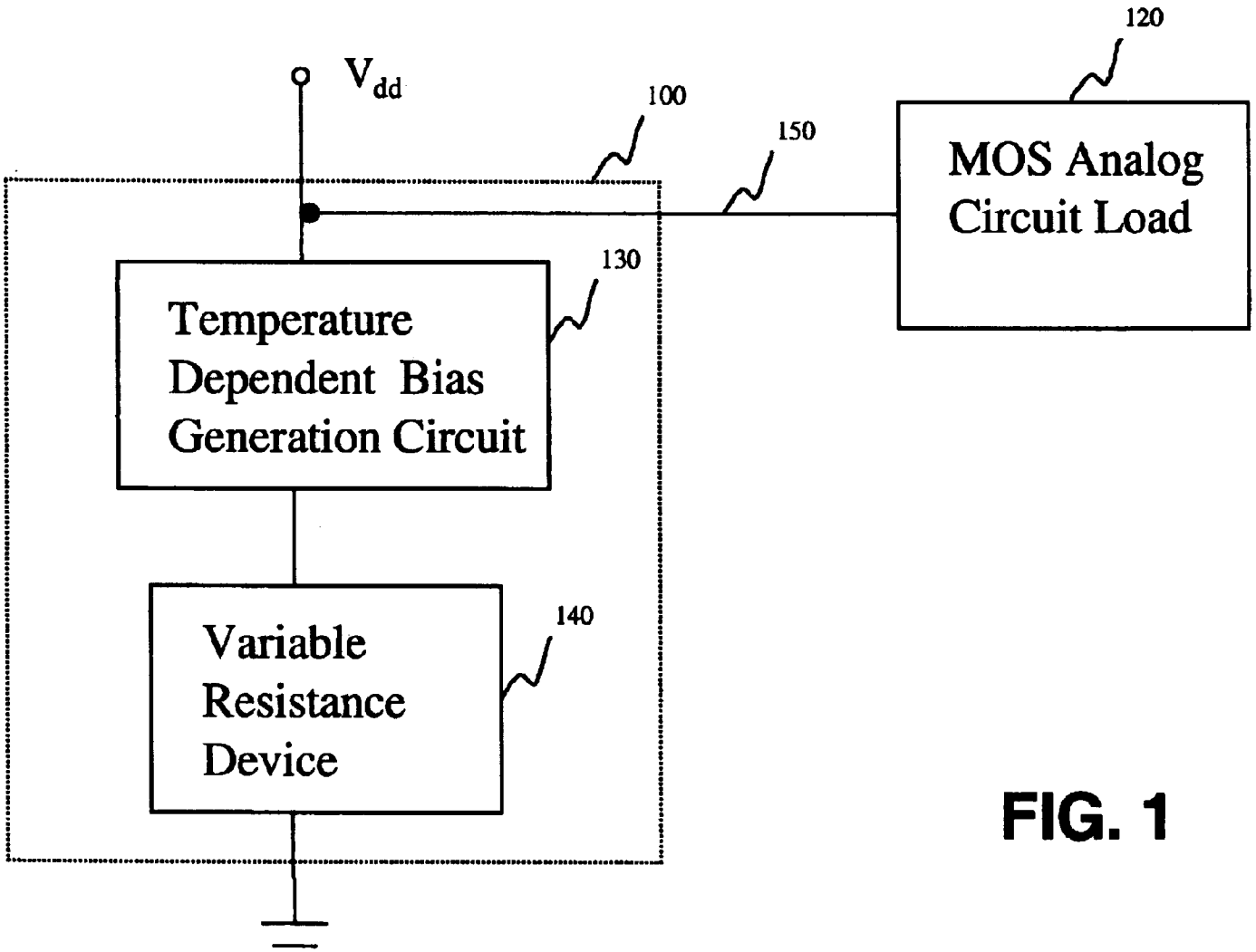
FIG. 1 is a simplified block diagram a high temperature coefficient bias generation circuit coupled to an analog MOS load in accordance with an exemplary embodiment of the present invention.

An exemplary embodiment of the present invention provides a method and apparatus for compensating for temperature induced variations in the performance of analog MOSFET circuits. For example, FIG. 1 is a simplified block diagram of an exemplary high temperature coefficient bias generation circuit 100 coupled to an analog MOS circuit 120. In an exemplary application the analog MOS circuit comprises, by way of example, one or more MOS transistors (not shown) coupled to the high temperature coefficient bias generation circuit 100. In an exemplary embodiment, the transconductance of the MOS transistors in the analog MOS circuit 120 decrease with increasing operational temperature.

Therefore, the described exemplary high temperature coefficient bias generation circuit 100 generates a high temperature coefficient bias current to compensate for the temperature induced variations in the performance of the analog MOSFET circuit. For example, in one embodiment the high temperature coefficient bias generation circuit 100 comprises, by way of example, a temperature dependent bias circuit 130 that produces a current that is dependent upon the absolute temperature to maintain a constant transconductance as temperature increases. The described exemplary high temperature coefficient bias generation circuit may further comprise a variable resistance device 140 coupled to the temperature dependent bias generation circuit.

In an exemplary embodiment the resistance of the variable resistance device increases with increasing temperature. In addition the output current 150 of the high temperature coefficient bias generation circuit increases as the resistance of the variable resistance device increases. The variable resistance device therefore increases the temperature coefficient of the high temperature coefficient bias generation circuit beyond the level that could be achieved with the temperature dependent bias generation circuit alone.

Figure 2:
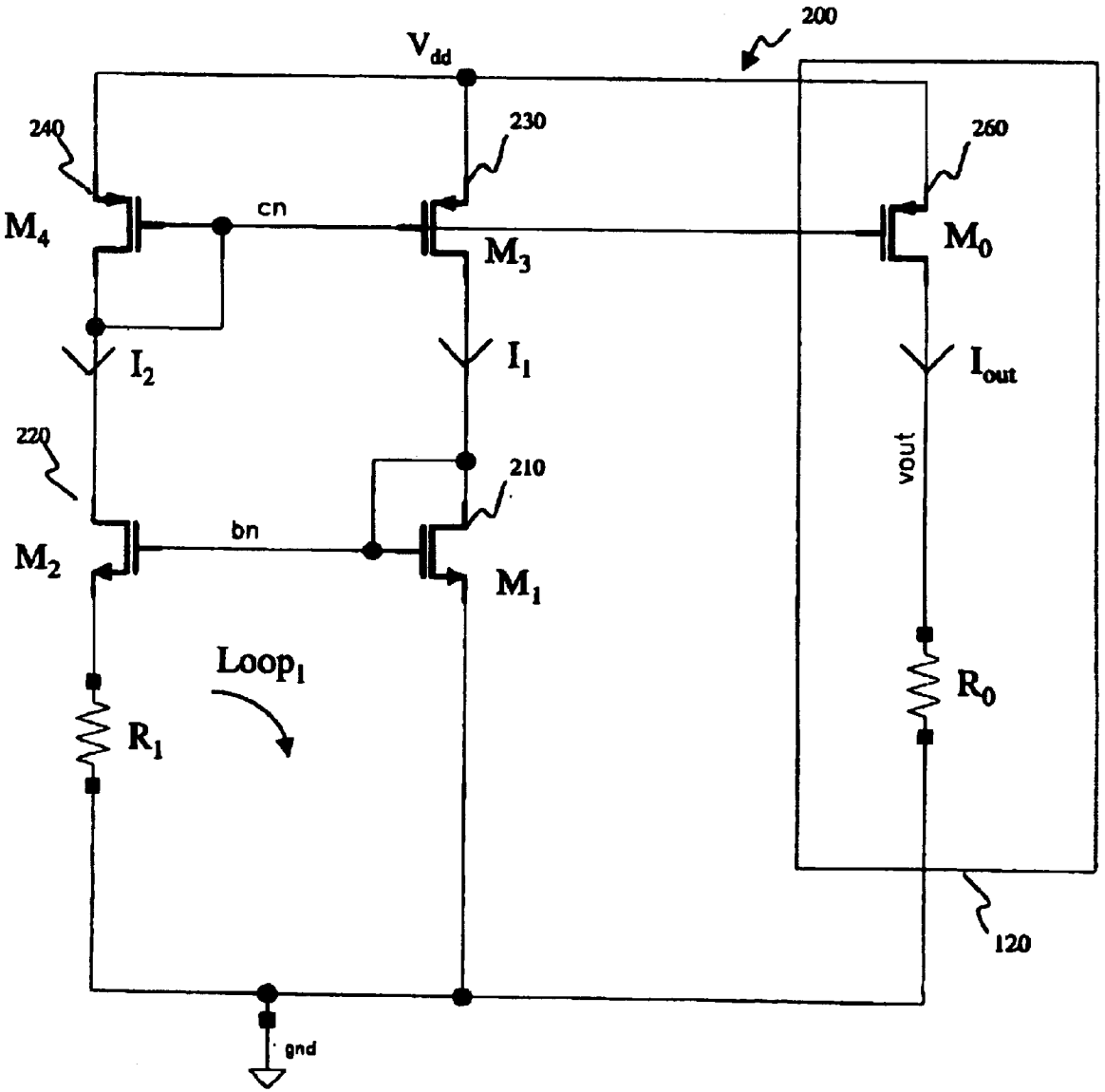
FIG.2 PRIOR ART
FIG. 2 is a simplified circuit diagram of a conventional temperature dependent bias generation circuit.

Many schemes have traditionally been used to provide a temperature dependent bias current to equalize the performance of MOS analog circuits as a function of temperature. For example, FIG. 2 illustrates a conventional bias generation circuit 200 for maintaining a constant transcondutance despite temperature changes and process variations. The bias generation circuit includes a pair of NMOS transistors 210 and 220 serially connected to a pair of PMOS transistors 230 and 240 between a positive voltage source (Vdd) and ground.

In an exemplary embodiment, NMOS transistor 210 has a source coupled to ground (GND), and a gate and drain coupled to each other. The drain of NMOS transistor 210 is further coupled to the drain of the PMOS transistor 230 and the gate of NMOS transistor 210 is also coupled to the gate of NMOS transistor 220. The source of the second NMOS transistor 220 is coupled via a resistor $R_1$ to ground and its drain is coupled to the drain of the PMOS transistor 240. The two PMOS transistors 230 and 240 are coupled at their sources to a constant voltage source $V_{dd}$ and at their gates to each other.

The PMOS transistors 230 and 240 form a current mirror for driving the NMOS transistors 210 and 220. In an exemplary embodiment PMOS transistors 230 and 240 are integrated devices, having similar characteristics. In addition, in one embodiment the drain source junction ($V_{ds}$) of PMOS transistor 230 equals the drain source voltage $V_{ds}$ of device 240. Therefore, the currents through the devices ($I_1$ and $I_2$) are essentially equal because the gates of the PMOS transistors 230 and 240 are at equal potential, that is, they are coupled together.

In operation the bias generation circuit 200 generates a bias current that is inversely proportional to the resistance of the setting resistor $R_1$. In this embodiment a PMOS transistor 260 transfers the bias current to a load, (illustrated, by way of example, as a resistive load $R_0$). Thus, the temperature dependent bias generation circuit of FIG. 2 compensates for first order variations in the transconductance of a MOS device due to process and temperature variations. More specifically, the Kirchoff voltage levels for the temperature dependent bias generation circuit (loop 1) are given by Eq. (1):

$$I_1R_1+V_{GS2}=V_{GS1} \tag{1}$$

In a typical bias generation circuit the NMOS transistors 210 and 220 are matched in characteristic and ignoring channel-length modulation and body effects, the gate to source voltage of NMOS transistor 210 is given by Eq. (2).

$$V_{GS1} = \sqrt{\frac{2I}{\mu_n C_{ox} W/L}} - V_T = \sqrt{\frac{2I}{\beta}} - V_T \tag{2}$$

where the transconductance parameter $\beta=\mu_n C_{ox}(W/L)$, where $C_{ox}$ is the oxide capacitance per unit area, $\mu_n$ is the mobility of the NMOS transistor 210 and W/L is the aspect ratio of NMOS transistor 210. Therefore the drain current for NMOS transistor 210 is given by Eq. (3).

$$I_D \approx \frac{3}{\frac{2\mu_n C_{ox}(W/L)}{R_1^2}} = \frac{3}{2BR_1^2} \tag{3}$$

and therefore transconductance is given by Eq. (4):

$$g_m = \sqrt{\frac{2BI}{3}} = \frac{1}{R_1} \tag{4}$$

Thus, disregarding body effects and assuming $I_1=I_2$, the transconductance of the PMOS current source transistor 260 is inversely proportional to the resistance of resistor $R_1$.

Figure 3:
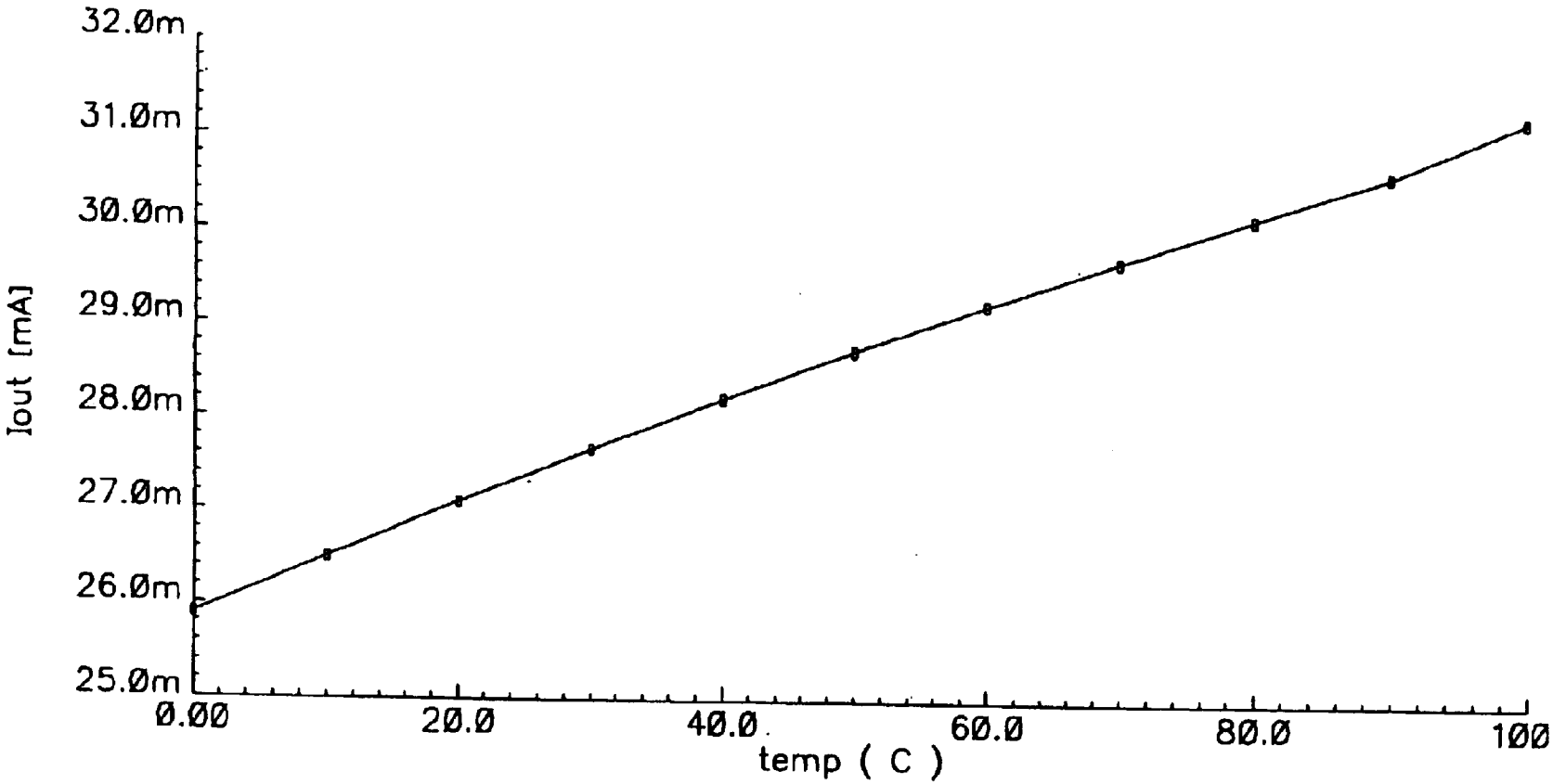
FIG.3 PRIOR ART
FIG. 3 graphically illustrates the output current of the temperature dependent bias generation circuit of FIG. 2 as a function of temperature.

FIG. 3 is a graphical illustration of the resultant output current $I_{out}$ versus temperature for the temperature dependent bias generation circuit 200. The illustrated embodiment of the temperature dependent bias generation circuit 200 generates an output current with a temperature coefficient of approximately 2,000 ppm/° C. (i.e. current varies approximately 20% for a 100 degree change in temperature). In certain applications however, the temperature coefficient of conventional temperature dependent bias generation circuits may not be large enough to provide sufficient temperature compensation.

For example, the output load for high frequency tuned applications, such as for example, open looped amplifiers, is typically an inductor whose effective series resistance has a relatively high temperature coefficient. Therefore, the effective impedance of the inductive load varies with temperature as does the resulting transconductance of the device. This may result in relatively large gain variation with varying temperature that may not be compensated for by conventional bias generation circuits alone.

In practice, a high temperature coefficient bias generation circuit can at least partially compensate for the temperature induced variation in gain that results at high frequencies. Therefore, an exemplary embodiment of the present invention comprises, by way of example, a bias generation circuit having a variable resistance device coupled to a temperature dependent bias generation circuit to generate a high temperature coefficient current that may be used to compensate for temperature induced variations in the performance of analog MOSFET circuits.

Figure 4:
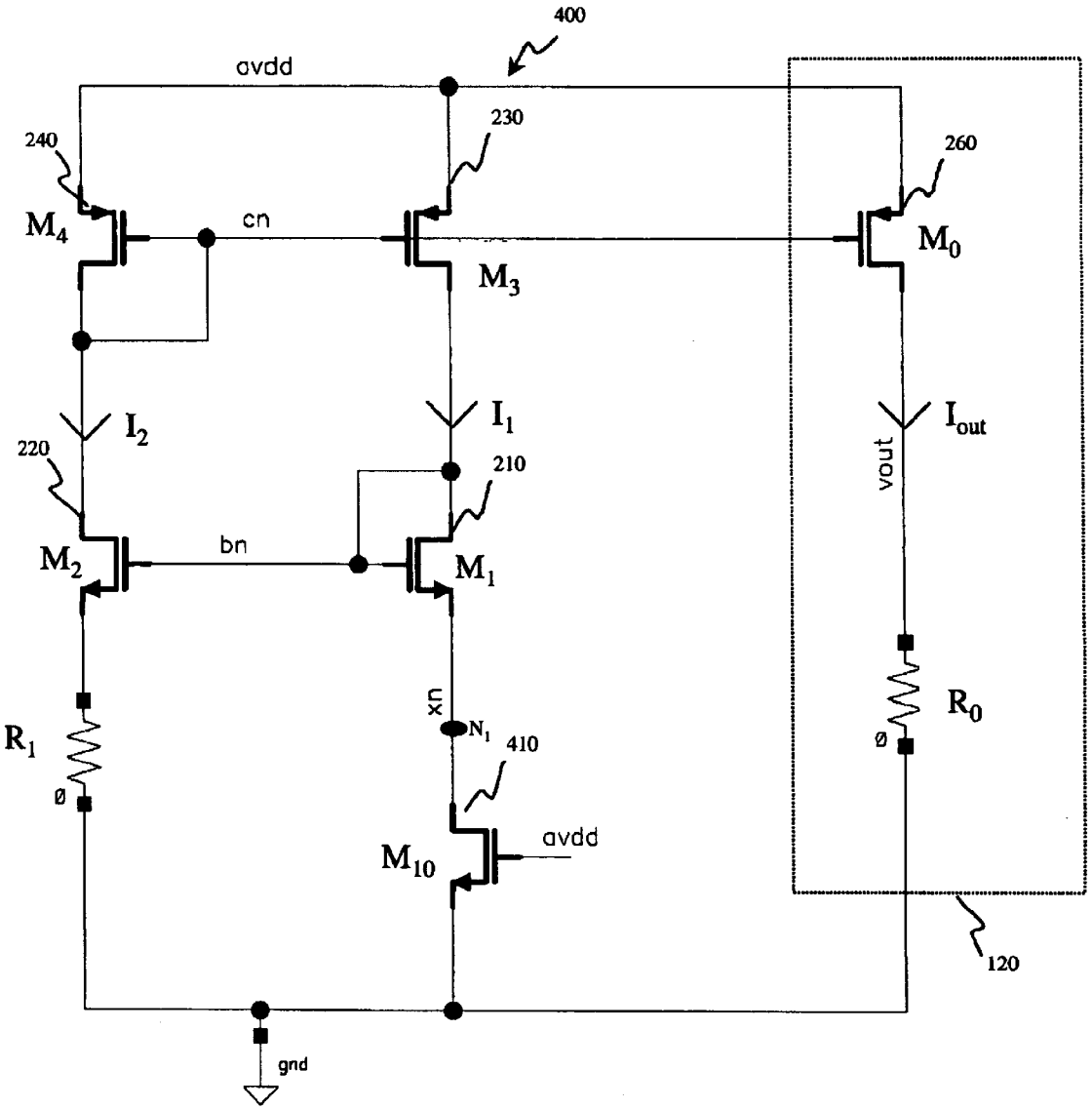
FIG. 4 is a simplified circuit diagram of a high temperature coefficient bias generation circuit comprising a triode transistor serially coupled with the temperature dependent bias generation circuit of FIG. 2 in accordance with an exemplary embodiment of the present invention.

Referring to FIG. 4, the described exemplary bias generation circuit 400 comprises a MOS triode transistor 410 coupled in series with NMOS transistor 210 and ground. The gate of the triode transistor is coupled to a positive voltage source, such as, for example $V_{dd}$, the level of which is chosen to ensure that triode transistor 410 operates in the triode region.

In operation, the on resistance and drain-source voltage ($V_{ds}$) of the triode transistor 410 increase with increasing temperature. In addition, the dependence of $V_{ds}$ on temperature varies as a function of device size (width). For example, in an exemplary embodiment of the present invention the change in $V_{ds}$ as a function of temperature increases as the width of the triode transistor 410 decreases. Therefore, the voltage at node $N_1$ coupled between the drain of the triode device 410 and source of the NMOS transistor 230 also increases as a function of increasing temperature. Further the voltage at node $N_1$ increases more as a function of increasing temperature as the size of the triode transistor 410 decreases.

Figure 5:
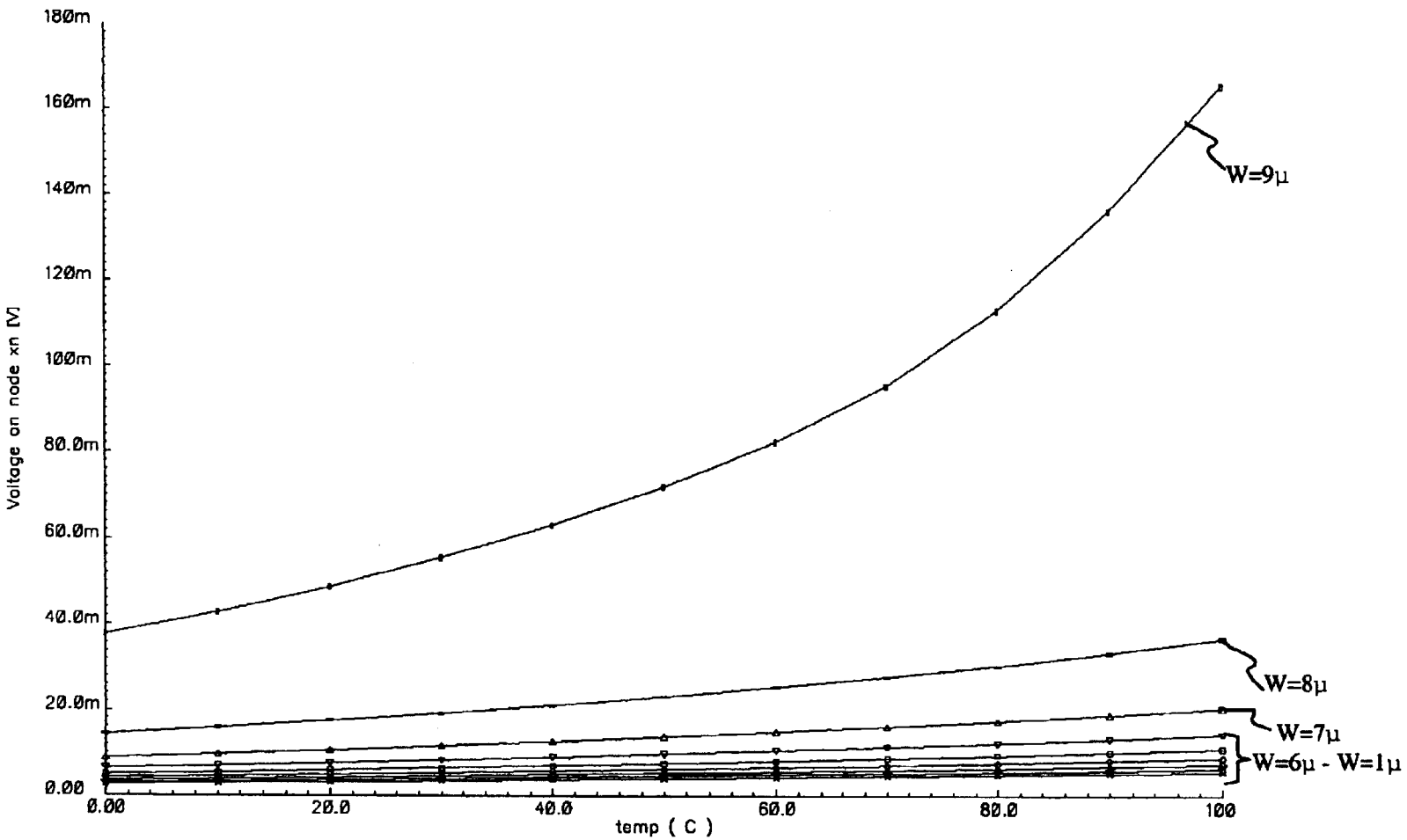
FIG. 5 graphically illustrates the voltage on a node between the triode transistor and the temperature dependent bias generation circuit of FIG. 4 as a function of temperature in accordance with an exemplary embodiment of the present invention.

For example, FIG. 5 graphically illustrates the voltage at node $N_1$ as a function of temperature for triode transistor widths ranging from nine microns to one micron. In practice the voltage at node $N_1$ increases in an approximately linear fashion with increasing temperature for device sizes greater than about two microns. The voltage at node $N_1$ increases over a greater range in a non-linear fashion with increasing temperature for a device width of one micron. Therefore, the temperature dependent voltage at node $N_2$ can be controlled by varying the size of the triode device 410.

In operation, a higher voltage at node $N_1$ as a function of increasing temperature effectively increases the output current of the bias generation circuit as a function of temperature. For example, the drain current of the output leg of the bias generation circuit can be defined as follows in Eq (5):

$$I_D \approx \frac{\dfrac{3}{2\mu_n C_{ox}(W/L)}}{\left(R_1 - \dfrac{1}{\mu_n C_{ox}(W/L)_t(V_{gs} - V_{t_t})}\right)^2} \tag{5}$$

where $V_{gs}$ is the gate source voltage of the triode device 410, $(W/L)_t$ is the aspect ratio of the triode device 410 and $V_{tt}$ is the threshold voltage of the triode device.

Thus, disregarding body effects and assuming $I_1=I_2$, the drain current of NMOS transistor 210 increases with decreasing device size. In addition, as the width of the triode device increases toward infinity, the effective on resistance (approximately equal to $1/\mu_n C_{ox}(W/L)_t(V_{gs}-V_{tt})$) and the voltage drop across the drain to source junction of the triode device approaches zero. Therefore, the drain current converges to the conventional solution provided by the bias generation circuit of FIG. 2 as the width of the triode device converges to infinity. Further, as the temperature increases the effective on-resistance of the triode device increases, increasing the drain current of the bias generation circuit.

Figure 6:
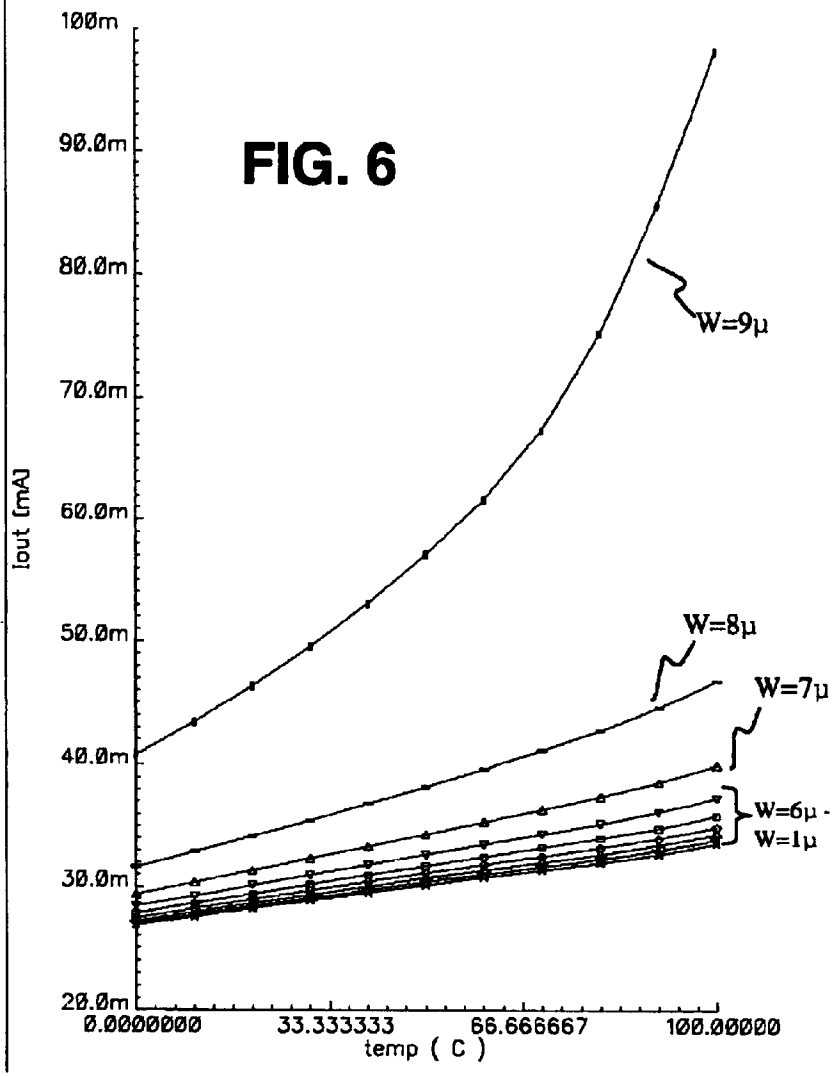
FIG. 6 graphically illustrates the output current of the high temperature coefficient bias generation circuit of FIG. 4 as a function of temperature in accordance with an exemplary embodiment of the present invention.

For example, FIG. 6 graphically illustrates the output current $I_{out}$ of bias generation circuit 400 (see FIG. 4) as a function of temperature for triode device widths ranging from one micron to nine microns. In operation, the output current of the described exemplary bias generation circuit increases on the order of about 5–10 mA over a 100° C. temperature increase for triode devices having a width between nine microns and two microns. However, the output current of the described exemplary bias generation circuit increases on the order of about 60 mA over 100° C. temperature increase for a one micron triode device.

Figure 7:
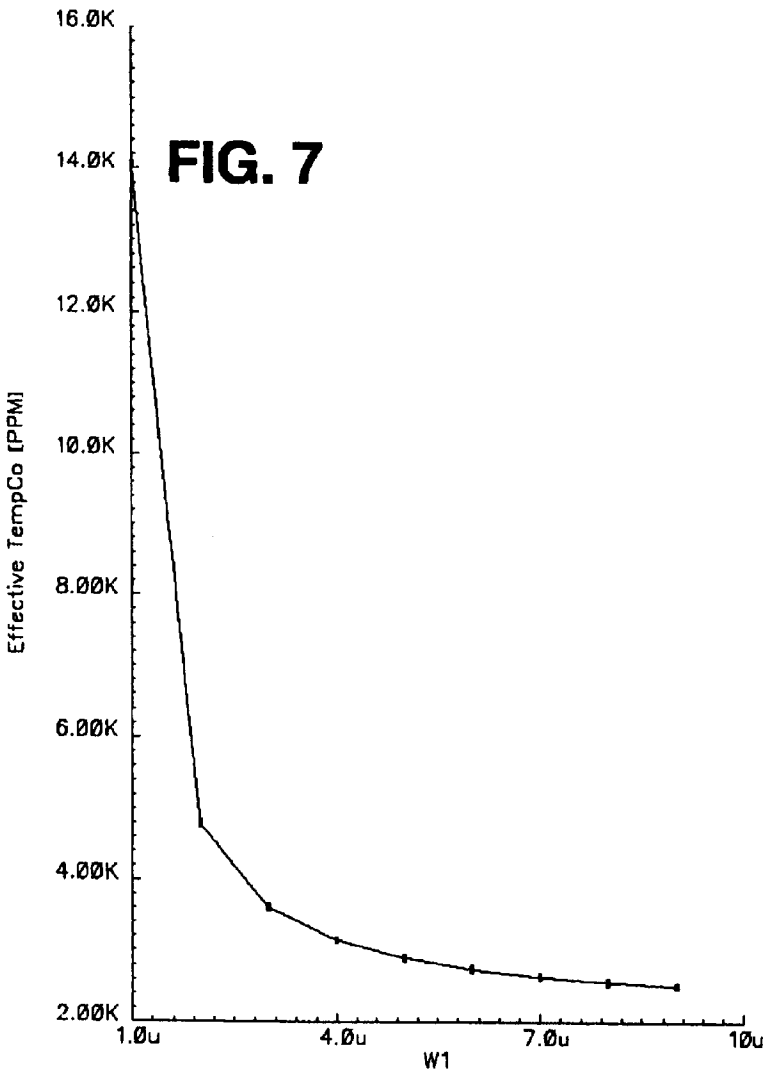
FIG. 7 graphically illustrates the effective temperature coefficient of the output current of FIG. 6 as a function of aspect ratio of the triode transistor of FIG. 4 in accordance with an exemplary embodiment of the present invention.

FIG. 7 graphically illustrates the corresponding effective temperature coefficient of the described exemplary bias generation circuit as a function of the size (width) of triode device 410. The effective temperature coefficient of the bias generation circuit for a triode device having a one micron width is in the range of about 14,000 PPM. In addition, as the size (width) of the triode device 510 is increased, the described exemplary bias generation circuit generates a current with a temperature coefficient that converges to that provided by the conventional bias generation circuit of FIG. 2.

One of skill in the art will appreciate that the width or aspect ratio of the triode device may be dynamically controlled to generate a current with a relatively wide dynamic range of temperature coefficient performance. For example, a multi-stage system comprising a plurality of parallel triodes may be dynamically switched on and off to provide a desired aspect ratio and corresponding output current as a function of temperature.

In addition, the high temperature coefficient bias current at least partially compensates for process variations which may further improve the performance of MOS circuits formed from devices having slow-MOS process corners. A process corner is a particular set of conditions related to processing involved in the manufacture and fabrication of an integrated circuit. A variation of process exists from the manufacture of one lot of chips to the manufacture of a second lot of chips. Process corners include slow process corners where the active MOS devices sink less current and therefore provide less gain.

In practice the loss of gain may be compensated for by increasing the bias current as the process moves toward a slow corner. In the described exemplary embodiment the on resistance of the triode device is proportional to process. Therefore, the on resistance increases for a slow process, increasing the output current of the bias generation circuit and compensating for the reduced gain of the analog device.

Figure 8:
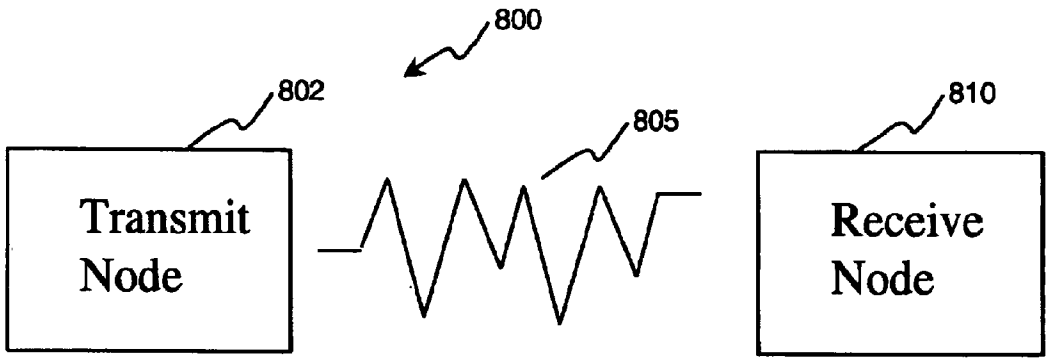
FIG. 8 is a simplified block diagram of a communication system having a transmit node and a receive node.

The described exemplary high temperature coefficient bias generation circuit may be integrated into any of a variety of RF circuit applications. For example, referring to FIG. 8, the described exemplary bias generation circuit may be incorporated into the transmit node 802 or receive node 810 of a typical communication system 800 for transmitting a radio frequency information signal 805 to a receive node 810 that receives and processes the transmitted RF information signal.

Figure 9:
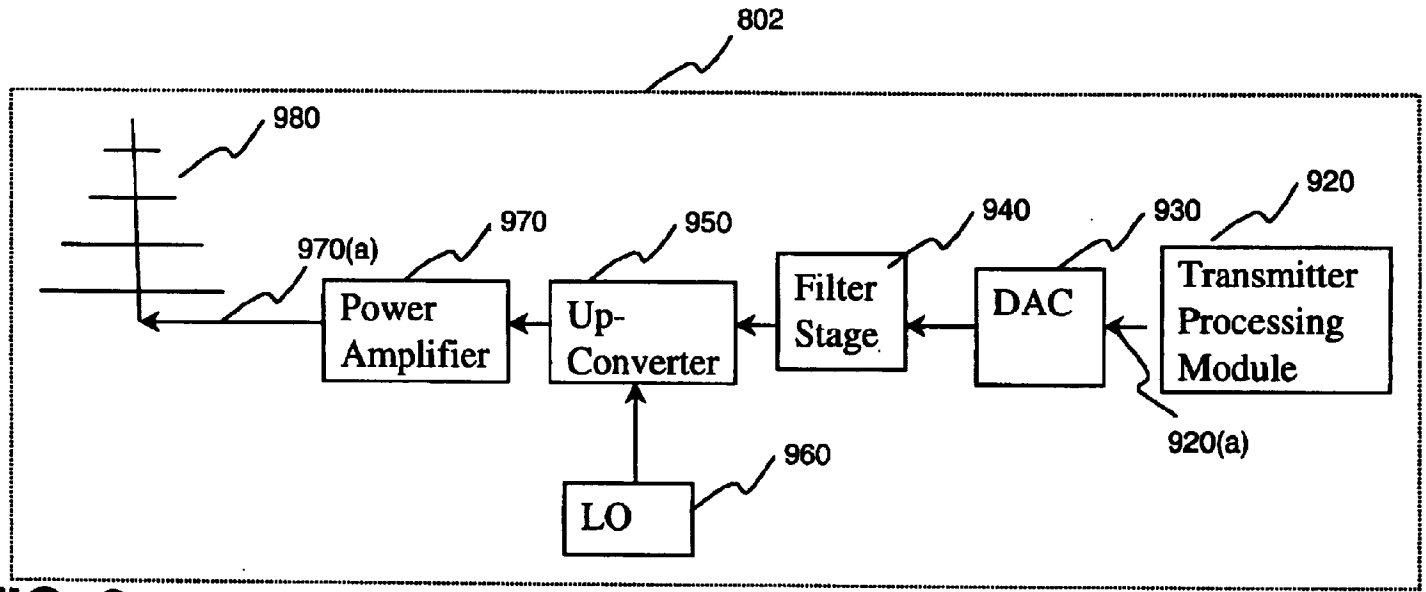
FIG. 9 is a simplified block diagram of the transmit node of FIG. 8 including an amplifier biased by the high temperature coefficient bias generation circuit of FIG. 4 in accordance with an exemplary embodiment of the present invention.

Referring to FIG. 9, an exemplary transmit node 802 includes, by way of example, a transmitter processing module 920 that receives and processes outbound data in accordance with one or more communication standards, including but not limited to, IEEE 802.11, Bluetooth, advanced mobile phone services (AMPS), global systems for mobile communications (GSM), code division multiple access (CDMA), local multi-point distribution systems (LMDS), multi-channel-multi-point distribution systems (MMDS), and or variations thereof. For example, the transmitter processing module may execute a variety of transmitter functions such as for example, scrambling, encoding, constellation mapping, and modulation to produce digital transmitter data 920(*a*) formatted in accordance with the appropriate communication standard.

The transmitter processing module may be implemented using a shared processing device, individual processing device, or a plurality of processing devices. For example, the processing module may comprise, a microprocessor, microcontroller, digital signal processor, microcomputer, central processing unit, state machine, or any other device that manipulates signals based upon operational instructions.

In an exemplary embodiment a digital to analog converter (DAC) 930 receives the digital transmitter data from the transmitter processing module and converts the digital transmitter data from the digital domain to the analog domain. The analog transmitter data is a IF or baseband signal typically in the frequency range of one hundred kilohertz to a few megahertz.

The analog transmitter data is forwarded to a filter stage 940 that filters the analog IF or baseband signal to attenuate unwanted out of band signals to produce a filtered IF signal that is coupled to an up-converter 950. The up-converter 950 converts the filtered analog IF or baseband signal into an RF signal based on a transmitter local oscillator signal provided by a local oscillator 960. An exemplary power amplifier 970 biased by the described exemplary high temperature coefficient bias generation circuit may adjust the gain and amplify the RF signal to produce an outbound RF signal 970(*a*) which is coupled to an antennae 980 for transmission to one or more receiver nodes.

The invention described herein will itself suggest to those skilled in the various arts, alternative embodiments and solutions to other tasks and adaptations for other applications. For example, the present invention is not limited to RF amplifier applications. Rather, the present invention may generally be used to bias any inductive MOS load that has sufficient headroom to support the large temperature coefficient current provided by the described exemplary bias generation circuit.

Further, the present invention is not limited to the use of an NMOS triode transistor serially coupled between the output leg of a Widlar current source and ground. Rather, the present invention may utilize a PMOS triode transistor or other devices having a resistance that varies with temperature such that the output current of the bias generation circuit increases with increasing resistance of the variable resistance device. It is the applicant's intention to cover by claims all such uses of the invention and those changes and modifications that could be made to the embodiments of the invention herein chosen for the purpose of disclosure without departing from the spirit and scope of the invention.

What is claimed is:

1. A high temperature coefficient circuit comprising:

a temperature dependent bias generation circuit serially coupled with a variable resistance device having a resistance that increases with increasing temperature, wherein an output current of the high temperature coefficient circuit is proportional to the resistance of the variable resistance device, and wherein the output current of the high temperature coefficient circuit drives an inductive load.

2. The high temperature coefficient circuit of claim 1 wherein the temperature dependent bias generation circuit comprises a current mirror serially coupled to a first pair of parallel transistors.

3. The high temperature coefficient circuit of claim 2 wherein gate electrodes of the first pair of parallel transistors are coupled together.

4. The high temperature circuit of claim 3 wherein a drain electrode of a first transistor of the first parallel pair of transistors on a first leg of the bias generation circuit is coupled to the gate of the first transistor.

5. The high temperature coefficient circuit of claim 2 wherein the current mirror comprises a second pair of parallel transistors wherein a source of each of the second pair of parallel transistors is coupled to a drain of a unique one of the first pair of parallel transistors.

6. A high temperature coefficient circuit comprising:

a temperature dependent bias generation circuit serially coupled with a variable resistance device having a resistance that increases with increasing temperature, wherein an output current of the high temperature coefficient circuit is proportional to the resistance of the variable resistance device, wherein the variable resistance device comprises a triode transistor, and wherein the output current of the high temperature coefficient circuit drives an inductive load.

7. The high temperature coefficient circuit of claim 6 wherein the triode transistor comprises a MOS triode transistor.

8. The high temperature coefficient circuit of claim 6 wherein the inductive load comprises a MOS analog circuit.

9. The high temperature coefficient circuit comprising:

a temperature dependent bias generation circuit serially coupled with a variable resistance device having a resistance that increases with increasing temperature, wherein an output current of the high temperature coefficient circuit is proportional to the resistance of the variable resistance device, wherein the temperature dependent bias generation circuit comprises a current mirror serially coupled to a first pair of parallel transistors, wherein gate electrodes of the first pair of parallel transistors are coupled together, and wherein a drain electrode of a first transistor of the first parallel pair of transistors an a first leg of the bias generation circuit is coupled to the gate of the first transistor; and a temperature setting resistor serially coupled to a second transistor of the first parallel pair of transistors on a second leg of the bias generation circuit, the temperature setting resistor having a second resistance, wherein the output current of the high temperature coefficient circuit is inversely proportional to the second resistance of the temperature setting resistor.

10. An RF communication system, comprising:

a transmit node for transmitting an RF information signal, the transmit node comprising a high temperature coefficient circuit for biasing an amplifier, wherein the high temperature coefficient circuit comprises, a temperature dependent bias generation circuit serially coupled with a variable resistance device having a resistance that increases with increasing temperature, wherein an output current of the high temperature coefficient circuit is proportional to the resistance of the variable resistance device; and a receive node for receiving the transmitted RF information signal.

11. The RF communication system of claim 10 wherein the temperature dependent bias generation circuit comprises a current mirror serially coupled to a first pair of parallel transistors.

12. The RF communication system of claim 10 wherein the variable resistance device comprises a triode transistor.

13. The RF communication system of claim 12 wherein the triode transistor comprises an MOS triode transistor.

14. A high temperature coefficient circuit comprising:

a current mirror serially coupled to a first pair of parallel transistors;

a variable resistance device serially coupled with a first transistor of the first pair of parallel transistors, wherein resistance of the variable resistance device increases with increasing temperature, wherein an output current of the high temperature coefficient circuit is proportional to the resistance of the variable resistance device, wherein gate electrodes of the first pair of parallel transistors are coupled together, and wherein a drain electrode of the first transistor of the first parallel pair of transistors is coupled to the gate of the first transistor; and a temperature setting resistor serially coupled to a second transistor of the first parallel pair of transistors, the temperature setting resistor having a second resistance, wherein the output current of the high temperature coefficient circuit is inversely proportional to the second resistance of the temperature setting resistor.

15. The high temperature coefficient circuit of claim 14 wherein gate electrodes of the first pair of parallel transistors are coupled together.

16. The high temperature coefficient circuit of claim 15 wherein a drain electrode of the first transistor of the first parallel pair of transistors is coupled to the gate of the first transistor.

17. The high temperature coefficient circuit of claim 14 wherein the current mirror comprises a second pair of parallel transistors wherein a source of each of the second pair of parallel transistors is coupled to a drain of a unique one of the first pair of parallel transistors.

18. A high temperature coefficient circuit comprising:

a current mirror serially coupled to a first pair of parallel transistors;

a variable resistance device serially coupled with a first transistor of the first pair of parallel transistors, wherein resistance of the variable resistance device increases with increasing temperature, wherein an output current of the high temperature coefficient circuit is proportional to the resistance of the variable resistance device, wherein the variable resistance device comprises a triode transistor, and wherein the output current of the high temperature coefficient circuit drives an inductive load.

19. The high temperature coefficient circuit of claim 18 wherein the triode transistor comprises an MOS triode transistor.

* * * * *

UNITED STATES PATENT AND TRADEMARK OFFICE

CERTIFICATE OF CORRECTION

PATENT NO. : 6,946,896 B2
DATED : September 20, 2005
INVENTOR(S) : Behzad

It is certified that error appears in the above-identified patent and that said Letters Patent is hereby corrected as shown below:

Column 7,
Line 46, after "temperature", insert -- coefficient --.

Column 8,
Line 3, delete "The high", insert -- A high --.
Line 15, delete "an a", insert -- on a --.
Line 44, delete "an MOS", insert -- a MOS --.

Column 10,
Line 10, delete "an MOS", insert -- a MOS --.

Signed and Sealed this

Twenty-fifth Day of April, 2006

JON W. DUDAS
*Director of the United States Patent and Trademark Office*